US009197016B2

(12) United States Patent
Han et al.

(10) Patent No.: US 9,197,016 B2
(45) Date of Patent: Nov. 24, 2015

(54) SELF-EJECTABLE PORT FIXING DEVICE

(71) Applicant: BOE TECHNOLOGY GROUP CO., LTD., Beijing (CN)

(72) Inventors: Yanling Han, Beijing (CN); Changlin Leng, Beijing (CN); Tianyue Zhao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 55 days.

(21) Appl. No.: 14/105,138

(22) Filed: Dec. 12, 2013

(65) Prior Publication Data

US 2014/0162481 A1 Jun. 12, 2014

(30) Foreign Application Priority Data

Dec. 12, 2012 (CN) ..... 2012 1 0537455

(51) Int. Cl.

| | |
|---|---|
| ***H01R 13/62*** | (2006.01) |
| ***H01R 13/629*** | (2006.01) |
| ***H01R 13/193*** | (2006.01) |
| ***H01R 13/635*** | (2006.01) |
| *H01R 24/62* | (2011.01) |

(52) U.S. Cl.

CPC ..... *H01R 13/629* (2013.01); *H01R 13/193* (2013.01); *H01R 13/635* (2013.01); *H01R 24/62* (2013.01)

(58) Field of Classification Search

CPC .. H01R 13/629; H01R 13/635; H01R 13/193; H01R 24/62

USPC ..... 439/152, 153, 159, 160

See application file for complete search history.

(56) References Cited

U.S. PATENT DOCUMENTS

| | | | | |
|---|---|---|---|---|
| 5,890,920 | A * | 4/1999 | David et al. | 439/159 |
| 6,644,995 | B1 | 11/2003 | Jones et al. | |
| 2002/0153420 | A1 | 10/2002 | Nakamura et al. | |

(Continued)

FOREIGN PATENT DOCUMENTS

| | | | |
|---|---|---|---|
| CN | 1797863 | A | 7/2006 |
| CN | 1848543 | A | 10/2006 |
| CN | 201402870 | Y | 2/2010 |

OTHER PUBLICATIONS

First Office Action for corresponding Chinese Patent Application No. 201210537455.8, 15 pages (including English Translation), (Aug. 4, 2014).

(Continued)

*Primary Examiner* — Javaid Nasri

(74) *Attorney, Agent, or Firm* — Blakely, Sokoloff, Taylor & Zafman LLP

(57) ABSTRACT

The present invention provides a self-ejectable port fixing device for contact connecting with a port having a port chip. The port fixing device comprises a casing having an opening through which the port chip is allowed to insert and to contact with a receptacle chip provided in the casing. The port fixing device further comprises an elastic unit and a locking unit. The elastic unit is compressed directly or indirectly by the port so as to accumulate elastic potential energy while the port chip is getting closer to the receptacle chip. When the port chip is in contact with the receptacle chip, the locking unit locks the port chip at this contacting position. When the locking unit is unlocked, the elastic unit releases the elastic potential energy to push the port chip to be detached from the receptacle chip.

10 Claims, 6 Drawing Sheets

(56) References Cited

U.S. PATENT DOCUMENTS

| | | | |
|---|---|---|---|
| 2003/0139077 | A1 | 7/2003 | Sasaki et al. |
| 2006/0024997 | A1 | 2/2006 | Teicher |
| 2006/0073720 | A1 | 4/2006 | Lin et al. |
| 2006/0141845 | A1 | 6/2006 | Hu et al. |
| 2006/0223352 | A1 | 10/2006 | Wada et al. |
| 2008/0299824 | A1 | 12/2008 | Legg |

OTHER PUBLICATIONS

European Patent Office Communication enclosing Extended European Search Report for corresponding European Patent Application No. 13195486.9, 7 pages. (Mar. 10, 2014).

* cited by examiner

SELF-EJECTABLE PORT FIXING DEVICE

FIELD OF THE INVENTION

The present invention relates to general electrical components field, and more particularly to a self-ejectable port fixing device.

BACKGROUND OF THE INVENTION

In related art, a USB receptacle (also referred to as a USB port fixing device) generally comprises a casing and a receptacle chip provided in the casing. The inner wall of the casing spaces away from the outer surface of the receptacle chip. The casing is made of metal sheets with good elasticity. A USB port generally comprises a casing and a port chip provided in the casing. The side of the port chip on which conductive contacts are provided keeps a distance away from the inner wall of the casing, wherein said distance is equal to the thickness of the receptacle chip in the USB receptacle. When performing data transmission as needed, the USB port is inserted into the USB receptacle, the receptacle chip of the USB receptacle is inserted into the gap between the inner wall of the casing of the USB port and the port chip, and the USB port is inserted into the gap between the inner wall of the casing of the USB receptacle and the receptacle chip, so that the conductive contacts on the port chip come into contact with the conductive contacts on the receptacle chip. In this case, the inner wall of the casing of the USB receptacle comes into tight contact with the outer wall of the casing of the USB port, to force the casing of the USB receptacle to be elastically deformed outward (i.e. in a direction away from the receptacle chip) so as to clamp the USB port. When the data transmission is over, the USB port is detached from the USB receptacle. Then, the casing of the USB receptacle is restored due to the detach of the inner wall of the casing of the USB receptacle from the outer wall of the casing of USB port. It can be seen that the USB port is fixed to the USB receptacle by the elastic deformation of the casing of the USB receptacle. However, such USB receptacle has the following disadvantages.

(1) In order to fix the USB port steadily so as to make the USB port not easy to fall off from the USB receptacle, it is usually designed to form an interference fit between the inner wall of the casing of the USB receptacle and the outer wall of the casing of the USB port. As result of manufacture processes or the like, sometimes the engagement between the USB port and the USB receptacle is too tight, which leads to difficulty in insertion/extraction of the USB port.

(2) When the USB port is inserted/extracted for too many times, the deformation of the casing of the USB receptacle is not readily to be restored sufficiently, which leads to poor contact between the conductive contacts on the port chip and the conductive contacts on the receptacle chip. As a result, the signals may be unstable, and the USB port may easily fall off from the USB receptacle.

At present, for the purpose of lightweight and thinness, the USB port without a casing has been developed. In the USB receptacle that cooperates with such USB port, the side of the receptacle chip on which conductive contacts are provided keeps a distance away from the inner wall of the casing of the USB receptacle. The port chip of said USB port is directly inserted into the gap between the inner wall of the casing and the receptacle chip of the USB receptacle, so that the conductive contacts on the port chip come into contact with the conductive contacts on the receptacle chip. However, such USB receptacle also has the above disadvantages.

SUMMARY OF THE INVENTION

Technical Problem

Directing to the above disadvantages in related art, the present invention provides a self-ejectable port fixing device, which not only fixes a port so that the port is not easy to fall off, but also facilitates the insertion/extraction of the port.

Technical Solution

A self-ejectable port fixing device for contact connecting with a port having a port chip is provided. The port fixing device comprises a casing having an opening and a receptacle chip provided in the casing. The port chip can be inserted into the opening of the casing to contact with the receptacle chip. Wherein, the port fixing device further comprises an elastic unit and a locking unit which are provided in the casing. The elastic unit is compressed directly or indirectly by the port so as to accumulate elastic potential energy as the port chip is getting closer to the receptacle chip, during the port chip being inserted into the casing through the opening of the casing to contact with the receptacle chip. When the port chip is in contact with the receptacle chip, the locking unit locks the port chip at this contact position. When the locking unit releases the lock, the elastic unit releases the elastic potential energy to push the port chip to be detached from the receptacle chip.

Preferably, the port fixing device further comprises a stopper. The stopper connects to the elastic unit and is arranged opposite to the receptacle chip. A side of the stopper and a side of the receptacle chip which face to each other are arranged in parallel and are spaced by a distance. The distance is equal to or slightly less than the width of the port chip and far less than the width of a handle end of the port. Said side of the receptacle chip which faces to the stopper is a side used for contacting with the port chip. The handle end of the port pushes the stopper to compress the elastic unit as the port chip is getting closer to the receptacle chip during the port chip is inserted into the casing through the opening of the casing to contact with the receptacle chip. When the locking unit releases the lock, the elastic unit releases the elastic potential energy so that the stopper pushes the handle end of the port in a direction away from a bottom wall of the casing, thus the port chip is detached from the receptacle chip.

Preferably, the port fixing device further comprises a supporting unit that is provided in the casing for supporting the receptacle chip.

Preferably, the supporting unit comprises a supporting rod. A bottom end of the supporting rod is fixed on the bottom wall of the casing. The receptacle chip is provided on a top end of the supporting rod. The distance between said side of the stopper and said side of the receptacle chip which face to each other is equal to the width of the port chip.

Preferably, the supporting unit comprises a spring piece having an inclined portion and a horizontal portion. An angle defined by the inclined portion and the horizontal portion as its two sides, with its vertex at the connection between the inclined portion and the horizontal portion, is an acute angle. The horizontal portion is provided on the bottom wall of the casing. A free end of the inclined portion is connected to the receptacle chip. The acute angle opens toward the stopper.

The distance between said side of the stopper and said side of the receptacle chip which face to each other is slight less than the width of the port chip.

Preferably, the port fixing device further comprises a stopper. The stopper is connected to the elastic unit. A through hole is opened in the stopper. The receptacle chip is provided in the through hole. A side of the receptacle chip which is used for contacting with the port chip and a side of the through hole which faces to said side of the receptacle chip used for contacting with the port chip are arranged in parallel and spaced by a distance. Said distance is equal to or slightly greater than the width of the port chip and far less than the width of a handle end of the port chip. The handle end of the port pushes the stopper to press the elastic unit as the port chip is getting closer to the receptacle chip, during the port chip is inserted into the through hole of the stopper to contact with the receptacle chip. When the locking unit releases the lock, the elastic unit releases the elastic potential energy so that the stopper pushes the handle end of the port away from a bottom wall of the casing, thus the port chip is detached from the receptacle chip.

Preferably, the port fixing device further comprises a support unit that is provided in the casing for supporting the receptacle chip.

Preferably, the supporting unit comprises a supporting rod. A bottom end of the supporting rod is fixed on the bottom wall of the casing. The receptacle chip is provided on a top end of the supporting rod. The distance between said side of the receptacle chip which is used for contacting with the port chip and said side of the through hole which faces to said side of the receptacle chip used for contacting with the port chip is equal to the width of the port chip.

Preferably, the supporting unit comprises a spring piece having an inclined portion and a horizontal portion. An angle defined by the inclined portion and the horizontal portion as its two sides, with its vertex at the connection between the inclined portion and the horizontal portion, is an acute angle. The horizontal portion is provided on the bottom wall of the casing. A free end of the inclined portion is connected to the receptacle chip. The acute angle opens toward the side of the through hole in the stopper which faces to said side of the receptacle chip used for contacting with the port chip. The distance between said side of the receptacle chip which is used for contacting with the port chip and said side of the through hole which faces to said side of the receptacle chip used for contacting with the port chip is slightly greater than the width of the port chip. During the port chip is inserted into the through hole of the stopper to contact with the receptacle chip, the handle end of the port pushes the stopper so that an edge of the bottom of the stopper, which is close to the through hole, presses against the inclined portion of the spring piece, thus the inclined portion accumulates elastic potential energy and brings the receptacle chip closer to the port chip so as to clamp the port chip. When the locking unit releases the lock so that the elastic unit pushes the stopper to move in the direction away from the bottom wall of the casing, the inclined portion releases the elastic potential energy to bring the receptacle chip to release and move away from the port chip.

Preferably, the locking unit is provided on the elastic unit. The locking unit is triggered when the port chip moves to a position where the port chip is in contact with the receptacle chip, so that the compressed state of the elastic unit is locked. The locking unit is triggered again when the port chip goes on moving in a direction toward the bottom wall of the casing, so that the compressed state of the elastic unit is unlocked.

Preferably, the locking unit is a push-type switch.

Advantageous Technical Effect

The self-ejectable port fixing device of the present invention has an elastic unit and a locking unit. Therefore, it is able to automatic fix and automatic eject the port, and prevents the port and the port fixing device from being damaged comparing with the related art in which the insertion/extraction of the port is performed entirely by an external force. Preferably, such port fixing device achieves automatic clamping and releasing a port by a stopper and a support unit. Thus, it not only fixes the port so that the port is not easy to fall off, but also facilitates insertion/extraction of the port.

| [Numerals of the Components in the Figures] | |
|---|---|
| 1: | a stopper |
| 2: | a connecting rod |
| 3: | a locking unit |
| 4: | an elastic unit |
| 5: | a casing |
| 6: | a receptacle chip |
| 7: | a spring piece |
| 8: | a port chip |
| 9: | a handle end |
| 10: | a supporting rod |
| 11: | a through hole |

DETAILED DESCRIPTION OF THE EMBODIMENTS

The self-ejectable port fixing device of the present invention will be described in detail based on the drawings and embodiments, in order that the technical solution of the present invention will be better understood by a person skilled in the art.

First Embodiment

Figure 1A:
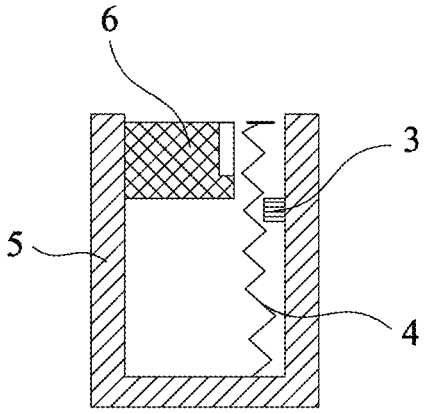
FIG. 1A is a structure diagram of the self-ejectable port fixing device according to a first embodiment of the present invention.
Figure 1B:
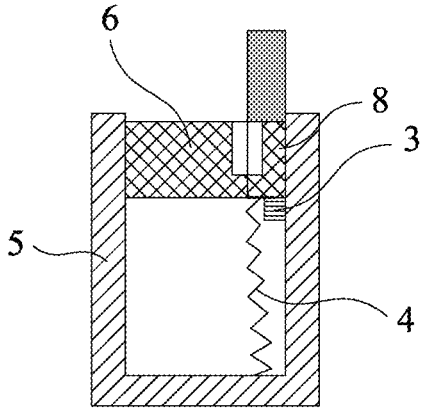
FIG. 1B is a diagram illustrating a state that a port is inserted into the port fixing device of FIG. 1A.

The first embodiment provides a self-ejectable port fixing device for contact connecting with a port. As illustrated in FIG. 1A, the port fixing device comprises a casing 5 having an opening, and a receptacle chip 6 provided in the casing. The port fixing device further comprises an elastic unit 4 and a locking unit 3. The port, which is used to connect with the port fixing device, comprises a port chip 8. As illustrated in FIG. 1B, the port chip 8 can be inserted into the opening of the casing 5 to contact with the receptacle chip 6 so as to transmit electric power and/or data.

The elastic unit 4 is used for accumulating elastic potential energy due to the compression applied thereon directly or indirectly by the port chip 8 as the port chip 8 is getting closer to the receptacle chip 6, during the port chip 8 is inserted into the casing 5 through the opening of the casing 5 to contact with the receptacle chip 6. Upon the port chip 8 is in contact with the receptacle chip 6, the locking unit 3 is used for locking the port chip 8 at this contacting position (i.e. a position where the port chip 8 stably contacts with the receptacle chip 6 so that electric connection or data connection can be established). Whereas, when the locking unit 3 releases the lock, the elastic unit 4 releases the elastic potential energy which is able to push the port chip 8 to move in the direction away from a bottom wall of the casing 5, in order that the port chip 8 is detached from the receptacle chip 6. Therefore, automatic fix and automatic ejection of the port is realized. Additionally, it is more easily for the port to be extracted from a port fixing device.

Preferably, the locking unit 3 may be provided on the elastic unit 4, so that the locking unit 3 is triggered when the port chip 8 moves to a position where the port chip 8 is in contact with the receptacle chip 6, thus the compressed state of the elastic unit 4 is locked. Further, the locking unit 3 is triggered again when the port chip 8 goes on moving toward the bottom wall of the casing 5 (i.e. in a direction away from the opening of the casing 5) after the port chip 8 contacts with the receptacle chip 6, so that the compressed state of the elastic unit 4 is unlocked.

Preferably, the locking unit 3 uses a push-type switch, i.e. a device which becomes locked when an external force is applied and which becomes released when an external force is applied again. Nevertheless, such push-type switch merely is an example, other devices such as a clutch, a positioner and the like may also be used, as long as it can lock the port chip 8 in a specified position (i.e. the contacting position as described above).

As for the present invention, it should be understood that "the port chip 8 is in contact with the receptacle chip 6" actually means that the conductive contacts in the port chip 8 are in contact with the conductive contacts in the receptacle chip 6 and thus the data can be transmitted, and "the port chip 8 is detached from the receptacle chip 6" means that the conductive contacts in the port chip 8 are detached from the conductive contacts in the receptacle chip 6 and thus the data transmission is stopped.

Second Embodiment

Figure 2:
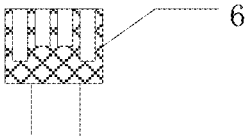
FIG. 2 is a side view of a receptacle chip of FIG. 1A.
Figure 5:
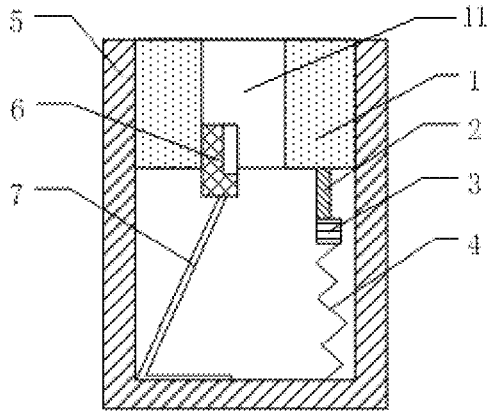
FIG. 5 is a structure diagram of the self-ejectable port fixing device according to a second embodiment of the present invention.

As illustrated in FIG. 5, the second embodiment preferably provides a self-ejectable port fixing device comprising a locking unit 3, an elastic unit 4, a casing 5, a receptacle chip 6 and a supporting unit. FIG. 2 is an enlarged side view of the receptacle chip 6 on which a plurality of conductive contacts may be provided.

Preferably, the port fixing device further comprises a stopper 1. The supporting unit comprises a spring piece 7. The casing 5 has an opening. The stopper 1, the locking unit 3, the elastic unit 4, the receptacle chip 6 and the spring piece 7 are provided inside the casing 5.

Figure 3:
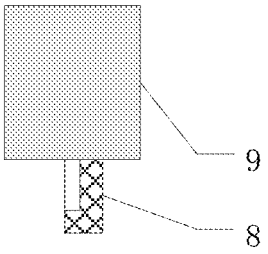
FIG. 3 is a structure diagram of the port.
Figure 4:
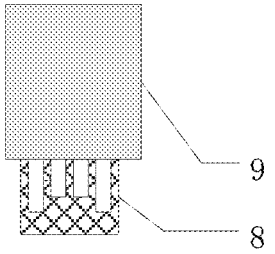
FIG. 4 is a side view of the port of FIG. 3.

The port fixing device is used in cooperation with a port. As illustrated in FIGS. 3 and 4, the port comprises a port chip 8 and a handle end 9. Preferably, the width of the handle end 9 is greater than the width of the port chip 8, as illustrated in FIG. 3. As illustrated in FIG. 4, conductive contacts are provided in the port chip 8 and can match with the conductive contacts in the receptacle chip 6, so that electric power and/or data can be transmitted when the port chip 8 is inserted into the opening of the casing 5 to contact with the receptacle chip 6.

With one end of the elastic unit 4 being connected to the stopper 1 and the other end of the elastic unit 4 being connected to the bottom wall of the casing 5, the elastic unit 4 is used for accumulating elastic potential energy when it is compressed by the stopper 1 while the port chip 8 is inserting into the casing 5 through the opening of the casing 5 to contact with the receptacle chip 6. The elastic unit 4 is also used for releasing the elastic potential energy so as to push the stopper 1 along with the port chip 8 to move accelerated in a direction away from the bottom wall of the casing when the port chip 8 is detaching from the receptacle chip 6. The locking unit 3 provided on the elastic unit 4 is triggered when the port chip 8 moves to a position where the port chip 8 contacts with the receptacle chip 6, thus the compressed state of the elastic unit 4 is locked. The locking unit 3 is triggered again when the port chip 8 goes on moving toward the bottom wall of the casing 5 (i.e. in a direction away from the opening of the casing) after the port chip 8 contacts with the receptacle chip 6 so that the compressed state of the elastic unit is unlocked and the elastic potential energy in the elastic unit 4 is released, thus the stopper 1 along with the port chip 8 are pushed to move accelerated in a direction away from the bottom wall of the casing, so that the port chip 8 detaches from the receptacle chip 6.

The stopper 1 is located at the opening of the casing 5 when the stopper 1 is free of external force. The stopper 1 is provided with a through hole 11. The receptacle chip 6 is provided in the through hole 11. The side of the receptacle chip 6 which is used to contact with the port chip 8 (hereinafter referred as "contact side") is parallel with the side in the through hole 11 of the stopper 1 which faces to said contact side of the receptacle 6. The spring piece 7 comprises an inclined portion and a horizontal portion. Said inclined portion and said horizontal portion are connected with each other, with the angle defined thereby at the connection is an acute angle. The horizontal portion is provided on the bottom wall of the casing 5. A free end of the inclined portion is connected to the receptacle chip 6. The acute angle opens toward the side of the through hole 11 in the stopper 1 which faces to said contact side. When the inclined portion is not deformed, the distance between the contact side of the receptacle chip 6 and the side in the through hole 11 of the stopper 1 which faces to said contact side of the receptacle 6 is slightly greater than the width of the port chip 8 and far less than the width of the handle end 9 of the port, so as to facilitate the insertion of the port 8 into the gap between said contact side of the receptacle chip 6 and said side of the through hole 11 in the stopper 1 which is parallel with said contact side of the receptacle chip 6.

With the port chip 8 moving in the direction toward the bottom wall of the casing 5, the handle end 9 connected to the port chip 8 pushes the stopper 1 to move in the direction toward the bottom wall of the casing. When the port chip 8 arrived at a position where it can contact with the receptacle chip 6, the compressed state of the elastic unit 4 is locked by the locking unit 3, so that the position of the stopper 1 connected to the elastic unit 4 is locked as well. It would be understood that the stopper 1 can be also provided in the casing 5. In this case where the stopper 1 is moved freely in the casing 5 as needed, the outer wall of the stopper 1 would not contact with or would slidably contact with the inner wall of the casing 5.

Figure 6:
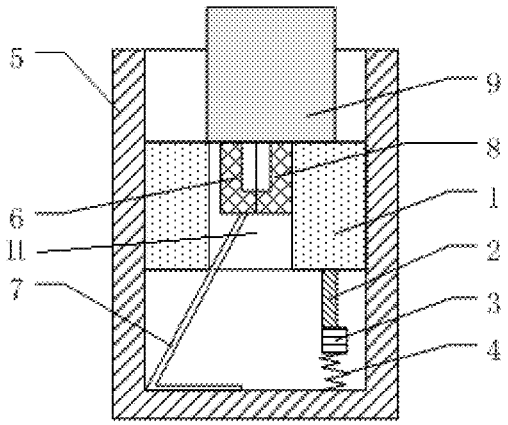
FIG. 6 is a diagram illustrating a state that the port of FIG. 3 is inserted into the self-ejectable port fixing device of FIG. 5.

During the stopper 1 is pushed by the handle end 9 to move in the direction toward the bottom wall of the casing, the edge on the bottom of the stopper 1, which is close to the through hole 11 (i.e. an edge which is relatively closest to the receptacle chip 6), to press the inclined portion of the spring piece 7 in the moving direction. This causes the inclined portion to incline toward the bottom wall so that the acute angle at the connection between the inclined portion and the horizontal portion becomes smaller. Thus, the elastic potential energy is accumulated and the receptacle chip 6 is brought to move toward the port chip 8. The port chip 8 is clamped between the side of the receptacle chip 6 which is used to contact with the port chip 8 and the side in the through hole 11 of the stopper 1 which faces to said contact side of the receptacle chip 6, as illustrated in FIG. 6. In other words, automatic clamping of the port chip 8 is realized, which makes the port chip 8 not easy to fall off from the port fixing device. When the elastic potential energy in the elastic unit 4 is released so as to push the stopper 1 to move in the direction away from the bottom wall of the casing, the elastic potential energy in the inclined portion of the spring piece 7 is released so that the receptacle chip 6 is brought to move away from the port chip 8. Thus, the clamping on the port chip 8 by the receptacle chip 6 is released, i.e. the port chip 8 is easy to be extracted from the port fixing device.

Preferably, the elastic unit 4 further comprises a connecting rod 2 at the top thereof. The connecting rod 2 is connected to the bottom of the stopper 1.

Third Embodiment

Figure 7:
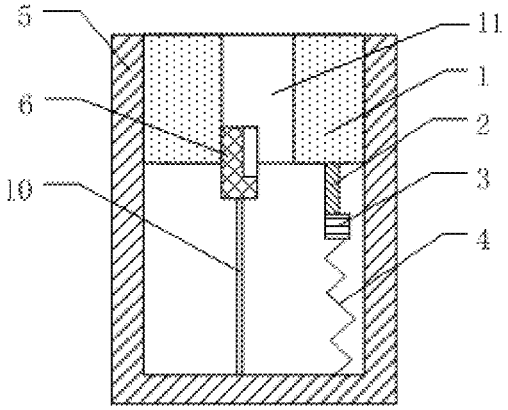
FIG. 7 is a structure diagram of the self-ejectable port fixing device according to a third embodiment of the present invention.
Figure 8:
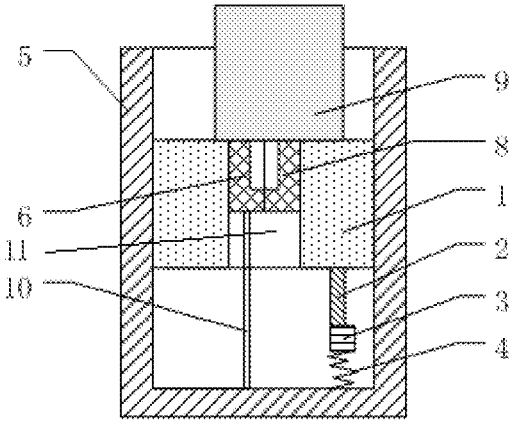
FIG. 8 is a diagram illustrating a state that the port of FIG. 3 is inserted into the self-ejectable port fixing device of FIG. 7.

As illustrated in FIGS. 7 and 8, the third embodiment distinguishes from the second embodiment in the following aspects.

In the third embodiment, the supporting unit in the port fixing device comprises a supporting rod 10, instead of the spring piece 7. The bottom of the supporting rod 10 is fixed on the bottom wall of the casing 5. The receptacle chip 6 is provided on the top of the supporting rod 10. The distance between the contact side of the receptacle chip 6 and the side in the through hole 11 of the stopper 1 which faces to said contact side of the receptacle chip 6 is equal to the width of the port chip 8. Thus, the port chip 8 can pass through the opening of the casing 5, insert into the gap between said contact side of the receptacle chip 6 and said side of the through hole 11 which is parallel with said contact side of the receptacle chip 6, and come into contact with the receptacle chip 6. Noted that, in the case of the locking unit 3 being a push-type switch, the supporting rod 10 should be made of materials somewhat of elasticity, so as to allow the receptacle chip 6 to move slightly downward together with the port chip 8 when the port chip 8 goes on moving in the direction toward the bottom wall of the casing after contacting with the receptacle chip 6, thus the locking unit 3 could be triggered again.

Other structures and their functions of the third embodiment are the same as those of the second embodiment, thus the redundant description thereof are omitted herein.

Fourth Embodiment

Figure 9:
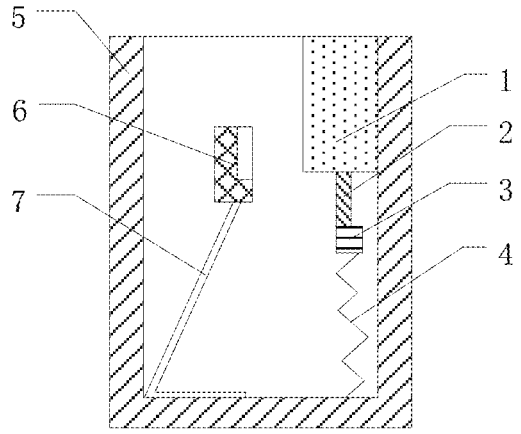
FIG. 9 is a structure diagram of the self-ejectable port fixing device according to a fourth embodiment of the present invention.
Figure 10:
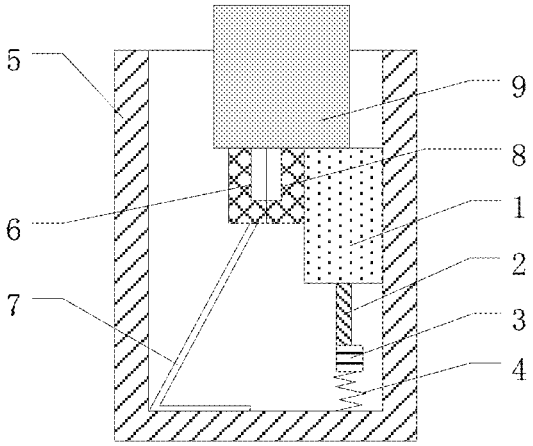
FIG. 10 is a diagram illustrating a state that the port of FIG. 3 is inserted into the self-ejectable port fixing device of FIG. 9.

As illustrated in FIGS. 9 and 10, the fourth embodiment distinguishes from the second embodiment in the following aspects.

The structure of the stopper 1 of the fourth embodiment is different from that of the second embodiment. In the fourth embodiment, the stopper 1 is located at the opening of the casing 5 facing to the receptacle chip 6 when the stopper 1 is free of external force. The stopper 1 is connected to the connecting rod 2 of the elastic unit 4. A side of the stopper 1 and a side of the receptacle chip 6, which face to each other, are arranged in parallel and are spaced by a distance. Said distance is slightly less than the width of the port chip 8 and far less than the width of the handle end 9 of the port. In this embodiment, when the port chip 8 passes through the opening of the casing 5, inserts into the gap between the stopper 1 and the receptacle chip 6, and comes into contact with the receptacle chip 6, the spring piece 7 connected to the receptacle chip 6 is pushed outwardly (i.e. in a direction away from the port chip 8). This is because the acute angle at the connection between the inclined portion and the horizontal portion of the spring piece 7 opens to the stopper 1, and the distance between said side of the stopper 1 and said side of the receptacle chip 6 which face to each other is slightly less than the width of the port chip 8. Meanwhile, the spring piece 7 forces the receptacle chip 6 to press the port chip 8 inwardly (i.e. in a direction toward the port chip). Thus, automatic clamping on the port chip 8 is realized, which makes the port chip 8 not easy to fall off from the port fixing device.

Also, because the distance between said side of the stopper 1 and said side of the receptacle chip 6 which face to each other is far less than the width of the handle end 9, the handle end 9 connected to the port chip 8 pushes the stopper 1 to move in the direction toward the bottom wall of the casing during the port chip 8 moves in the same direction. When the port chip 8 moves to a position where it contacts with the receptacle chip 6, the compressed state of the elastic unit 4 is locked by the locking unit 3, so that the position of the stopper 1 connected to the elastic unit 4 is locked as well.

Other structures and their functions of the fourth embodiment are the same as those of the second embodiment, thus the redundant description thereof are omitted herein.

Fifth Embodiment

Figure 11:
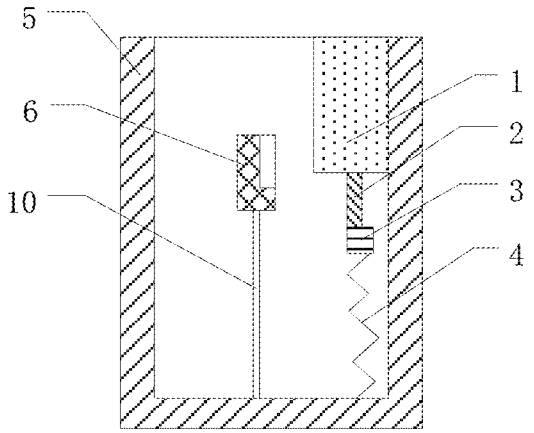
FIG. 11 is a structure diagram of the self-ejectable port fixing device according to a fifth embodiment of the present invention.
Figure 12:
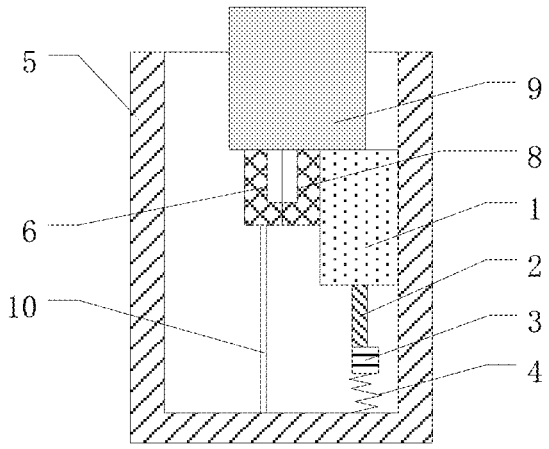
FIG. 12 is a diagram illustrating a state that the port of FIG. 3 is inserted into the self-ejectable port fixing device of FIG. 11.

As illustrated in FIGS. 11 and 12, the fifth embodiment distinguishes from the fourth embodiment in the following aspects.

In the fifth embodiment, the supporting unit of the port fixing device comprises a supporting rod 10, instead of the spring piece 7. The bottom of the supporting rod 10 is fixed on the bottom wall of the casing 5. The receptacle chip 6 is provided on the top of the supporting rod 10. The distance between said side of the stopper 1 and said side of the receptacle chip 6 which face to each other is equal to the width of the port chip 8. Thus, the port chip 8 can pass through the opening of the casing 5, insert into the gap between the stopper 1 and the receptacle chip 6, and come into contact with the receptacle chip 6.

During the port chip 8 moves in the direction toward the bottom wall of the casing 5, the handle end 9 connected to the port chip 8 pushes the stopper 1 to move in the direction toward the bottom wall of the casing 5. When the port chip 8 moves to a position where it contacts with the receptacle chip 6, the compressed state of the elastic unit 4 is locked by the locking unit 3, so that the position of the stopper 1 connected to the elastic unit 4 is locked as well.

Other structures and their functions of the fifth embodiment are the same as those of the fourth embodiment, thus the redundant description thereof are omitted herein.

It should be noted that the port of the present invention may be a USB port or any other type of ejectable port. Correspondingly, the port fixing device of the present invention may be a USB port fixing device or any other type of ejectable port fixing device.

It should be understood that the foregoing embodiments are merely exemplary for explaining the principle of the present invention. Nevertheless, the present invention is not limited thereto. It is possible for a person skilled in the art to make various modifications and improvements without departing from the spirit of the present invention, which should be deemed as fall into the scope of the present invention as well.

What is claimed is:

1. A self-ejectable port fixing device for contact connecting with a port having a port chip comprises:

a casing having an opening;

a receptacle chip provided in the casing, wherein the port chip is allowed to insert into the opening of the casing to contact with the receptacle chip; and an elastic unit and a locking unit which are provided in the casing, with the elastic unit being compressed directly or indirectly by the port chip so as to accumulate elastic potential energy as the port chip is getting closer to the receptacle chip, during the port chip being inserted into the casing through the opening of the casing to contact with the receptacle chip, wherein the port fixing device further comprises a supporting unit that is provided in the casing for supporting the receptacle chip, when the port chip is in contact with the receptacle chip, the locking unit locks the port chip at this contact position, and when the locking unit releases the port that is locked at this contact position, the elastic unit releases the elastic potential energy to push the port chip to be detached from the receptacle chip.

2. The port fixing device of claim 1 further comprises a stopper that is connected to the elastic unit, wherein a handle end of the port chip pushes the stopper to compress the elastic unit as the port chip is getting closer to the receptacle chip during the port chip is inserted into the casing through the opening of the casing to contact with the receptacle chip, and when the locking unit releases the lock, the elastic unit releases the elastic potential energy so that the stopper pushes the handle end of the port in a direction away from a bottom wall of the casing, thus the port chip is detached from the receptacle chip.

3. The port fixing device of claim 2, wherein the stopper is arranged opposite to the receptacle chip, a side of the stopper and a side of the receptacle chip which face to each other are arranged in parallel and are spaced by a distance, the distance is equal to or slightly less than a width of the port chip and far less than a width of the handle end of the port, and said side of the receptacle chip which faces to the stopper is a side used for contacting with the port chip.

4. The port fixing device of claim 3, wherein the supporting unit comprises a supporting rod, with a bottom end of the supporting rod being fixed on a bottom wall of the casing and the receptacle chip being provided on a top end of the supporting rod, and a distance between said side of the stopper and said side of the receptacle chip which face to each other is equal to the width of the port chip.

5. The port fixing device of claim 3, wherein the supporting unit comprises a spring piece having an inclined portion and a horizontal portion, with an angle defined by the inclined portion and the horizontal portion as its two sides and its vertex at a connection between the inclined portion and the horizontal portion being an acute angle, the horizontal portion is provided on the bottom wall of the casing, and a free end of the inclined portion is connected to the receptacle chip, the acute angle opens toward the stopper, and the distance between said side of the stopper and said side of the receptacle chip which face to each other is slight less than the width of the port chip.

6. The port fixing device of claim 2, wherein a through hole is opened in the stopper, the receptacle chip is provided in the through hole, the side of the receptacle chip which is used for contacting with the port chip and the side of the through hole which faces to said side of the receptacle chip used for contacting with the port chip are arranged in parallel and spaced by a distance, and said distance is equal to or slightly greater than the width of the port chip and far less than the width of the handle end of the port chip.

7. The port fixing device of claim 6, wherein the supporting unit comprises a supporting rod, with a bottom end of the supporting rod being fixed on the bottom wall of the casing and the receptacle chip being provided on a top end of the supporting rod, and the distance between said side of the receptacle chip which is used for contacting with the port chip and said side of the through hole which faces to said side of the receptacle chip used for contacting with the port chip is equal to the width of the port chip.

8. The port fixing device of claim 6, wherein the supporting unit comprises a spring piece having an inclined portion and a horizontal portion, with an angle defined by the inclined portion and the horizontal portion as its two sides and its vertex at the connection between the inclined portion and the horizontal portion being an acute angle, the horizontal portion is provided on the bottom wall of the casing, and a free end of the inclined portion is connected to the receptacle chip, the acute angle opens toward the side of the through hole in the stopper which faces to said side of the receptacle chip used for contacting with the port chip, the distance between said side of the receptacle chip which is used for contacting with the port chip and said side of the through hole which faces to said side of the receptacle chip used for contacting with the port chip is slightly greater than the width of the port chip, during the port chip is inserted into the through hole of the stopper to contact with the receptacle chip, the handle end of the port pushes the stopper so that an edge of the bottom of the stopper, which is close to the through hole, presses against the inclined portion of the spring piece, thus the inclined portion accumulates elastic potential energy and brings the receptacle chip closer to the port chip so as to clamp the port chip, and when the locking unit releases the lock so that the elastic unit pushes the stopper to move in the direction away from the bottom wall of the casing, the inclined portion releases the elastic potential energy to bring the receptacle chip to release and move away from the port chip.

9. The port fixing device of claim 1, wherein the locking unit is provided on the elastic unit, the locking unit is triggered when the port chip moves to a position where the port chip is in contact with the receptacle chip, so that a compressed state of the elastic unit is locked, and the locking unit is triggered again when the port chip goes on moving in a direction toward the bottom wall of the casing, so that the compressed state of the elastic unit is unlocked.

10. The port fixing device of claim 9, wherein the locking unit is a push-type switch.

* * * * *